United States Patent [19]

Da Costa

[11] Patent Number: 5,022,835

[45] Date of Patent: Jun. 11, 1991

[54] HERMETIC COMPRESSOR WITH CRANKSHAFT HAVING ECCENTRIC PISTON PORTION WITH HYDRODYNAMIC WEDGE

[75] Inventor: Caio M.F.N. Da Costa, Joinville, Brazil

[73] Assignee: Empresa Brasileira De Compressores S/A - Embraco, Joinville, Brazil

[21] Appl. No.: 439,668

[22] Filed: Nov. 21, 1989

[30] Foreign Application Priority Data

Nov. 24, 1988 [BR] Brazil ..... PI 8806263

[51] Int. Cl.[5] ..... F04C 18/356; F04C 29/10

[52] U.S. Cl. ..... 418/63; 74/595; 418/77

[58] Field of Search ..... 418/63, 77, 79; 74/595, 74/596, 597; 184/6.15

[56] References Cited

U.S. PATENT DOCUMENTS 2,022,610 11/1935 Wendell ..... 418/77
3,193,052 7/1965 Baumler et al. ..... 418/77

FOREIGN PATENT DOCUMENTS 85284 5/1985 Japan ..... 418/77
195395 10/1985 Japan ..... 418/77

*Primary Examiner*—Leonard E. Smith
*Assistant Examiner*—David L. Cavanaugh
*Attorney, Agent, or Firm*—Darby & Darby

[57] ABSTRACT

A crankshaft for a hermetic compressor of the type that comprises a piston which is displaced in the interior of a cylinder by action of an eccentric portion of the crankshaft which is rotatively driven by the electric motor of the compressor, so that the outer face of the eccentric portion facing the axial bearing is spaced according to a surface portion defining an inclined outer face portion which produces a hydrodynamic wedge at the crankshaft eccentric portion.

16 Claims, 2 Drawing Sheets

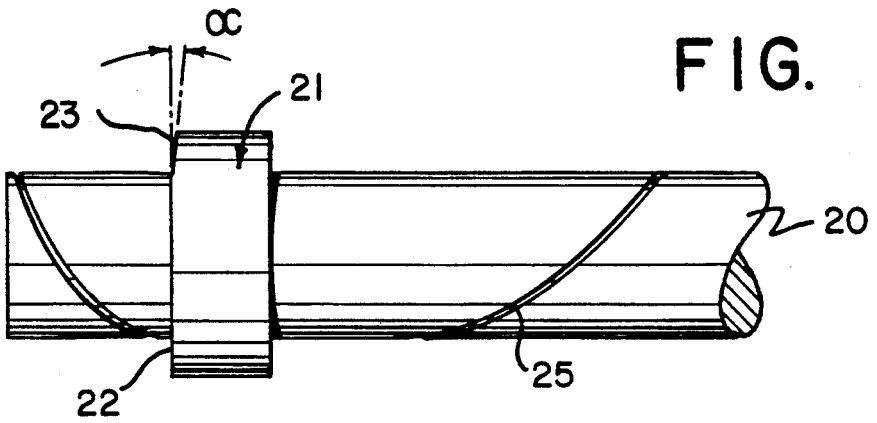
FIG. 4
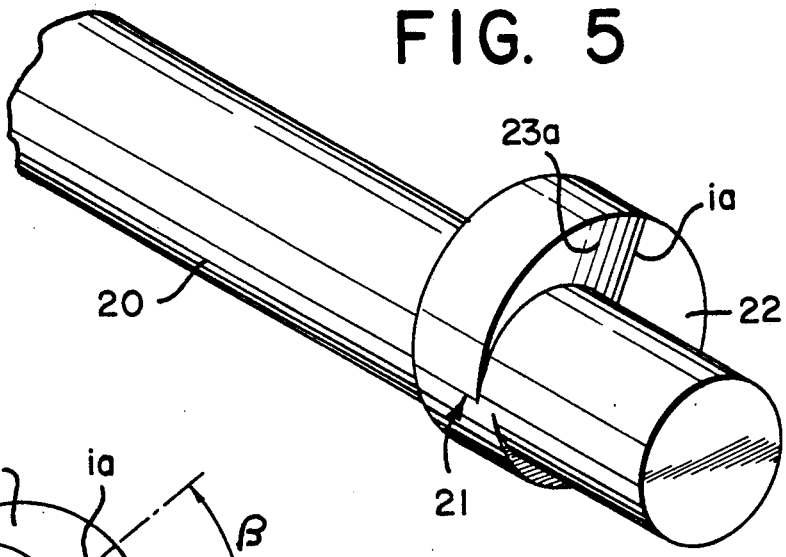
FIG. 5
FIG. 6
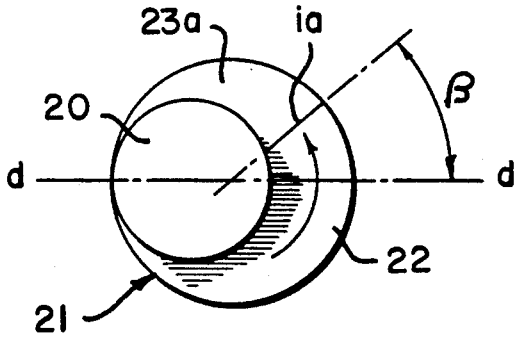
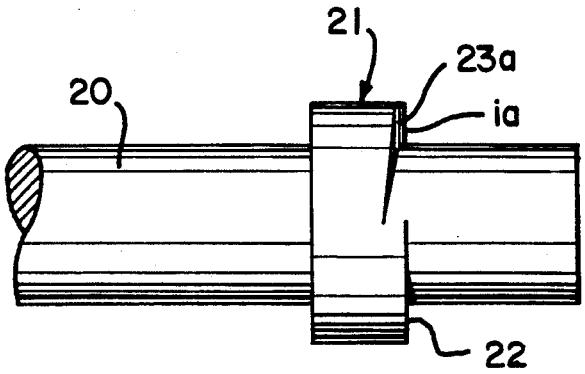
FIG. 7

HERMETIC COMPRESSOR WITH CRANKSHAFT HAVING ECCENTRIC PISTON PORTION WITH HYDRODYNAMIC WEDGE

BACKGROUND OF THE INVENTION

The present invention relates to a crankshaft for a hermetic compressor, and more specifically to a new configuration for the axial bearing (thrust bearing) of the crankshaft eccentric portion.

Rotary rolling piston compressors, for example, have in the crankshaft an eccentric portion to give the rotation and translation movement to the rolling piston. This eccentric portion (or eccentric only) is mounted between the walls of a pair of bearing so that, in operation, it tends to ride against one of these bearings, and more commonly on the sub bearing. The bearing that operates to axially constrain the crankshaft is hereafter called an axial bearing.

With the shaft rotation during compressor operation, the eccentric bears against the wall of the cover or axial bearing. This causes energy loss by friction which obviously increases the compressor power consumption. This is particularly true for upright compressors, both rotary and reciprocal, where all rotor weight of the electric motor bears against the axial bearing.

Even in horizontal compressors the loss by friction can happen, since the magnetic force of the electric motor axially pushes the shaft and, therefore, makes the piston eccentric bear against the axial bearing wall. An attempt to solve this problem in reciprocating compressors by the use of rolling bearings which always are, for any type of compressor, an expensive and problematic solution. Another attempt to reduce the loss by friction is through the insertion of washers of various materials of a smaller friction coefficient in the axial bearing which also is an expensive and complicated process.

OBJECT OF THE INVENTION

It is the object of the invention to provide a crankshaft configuration with eccentric portion which considerably reduces the loss by friction in the axial bearing, that is of easy and inexpensive production and does not need the inclusion of any new device or component is the compressor set.

It is also an object of the present invention to provide a crankshaft of the type above mentioned and, although subject to axial friction, can be used in any type of hermetic compressor for small refrigeration appliances.

BRIEF DESCRIPTION OF THE INVENTION

The crankshaft of the invention is to be applied in a hermetic compressor of the type that comprises a piston moved in the interior of a cylinder by action of an eccentric portion of the crankshaft which is rotatively driven by the electric motor of the compressor. The axial force applied on the crankshaft is absorbed by the surface of at least one axial thrust bearing, arranged around the crankshaft and adjacent to one of the outer faces of the crankshaft eccentric portion.

According to the present invention, the outer face of the crankshaft eccentric portion facing the axial bearing has a section with an inclined surface. This inclined section is in one of the halves of the outer face defined by the diameter of the latter which goes through its maximum and minimum eccentricity points. The surface is inclined to the plane of the end face by an angle between somewhat greater than 0° and 5°, in a way to provide a hydrodynamic wedge on the said outer face of the crankshaft eccentric portion.

According to a first embodiment of the invention, the section with the inclined surface has the shape of a plane defining with the said outer face of the eccentric portion, an intersection line tangent to the crankshaft and parallel or inclined regarding the diameter of the end face.

In a second embodiment of the invention, the section with the inclined surface defines, with the outer face, the said portion of the inclined extreme face crosses the diametrical plane which has the said outer face diameter at least at the minimum eccentricity region, in a point axially displaced, along the length of the crankshaft from the plane of the outer face.

With the compressor rotation, the hydrodynamic wedge, created by the separation of part of the end face of the crankshaft eccentric portion, creates together with the lubricant oil a layer of hydrodynamic sustenance, maintaining the outer face of the eccentric portion away from the adjacent wall of the axial bearing. This arrangement reduces the losses by friction and decreases the wear of the two parts of the set.

BRIEF DESCRIPTION OF THE DRAWINGS

The invention will be described as follows by making reference to the accompanying drawings, wherein:

FIG. 4 is a side view of the crankshaft of FIGS. 2 and 3; and

FIGS. 5, 6 and 7 are similar views corresponding to FIGS. 2, 3 and 4, respectively, illustrating a second embodiment of the invention.

DETAILED DESCRIPTION OF THE INVENTION

Figure 1:
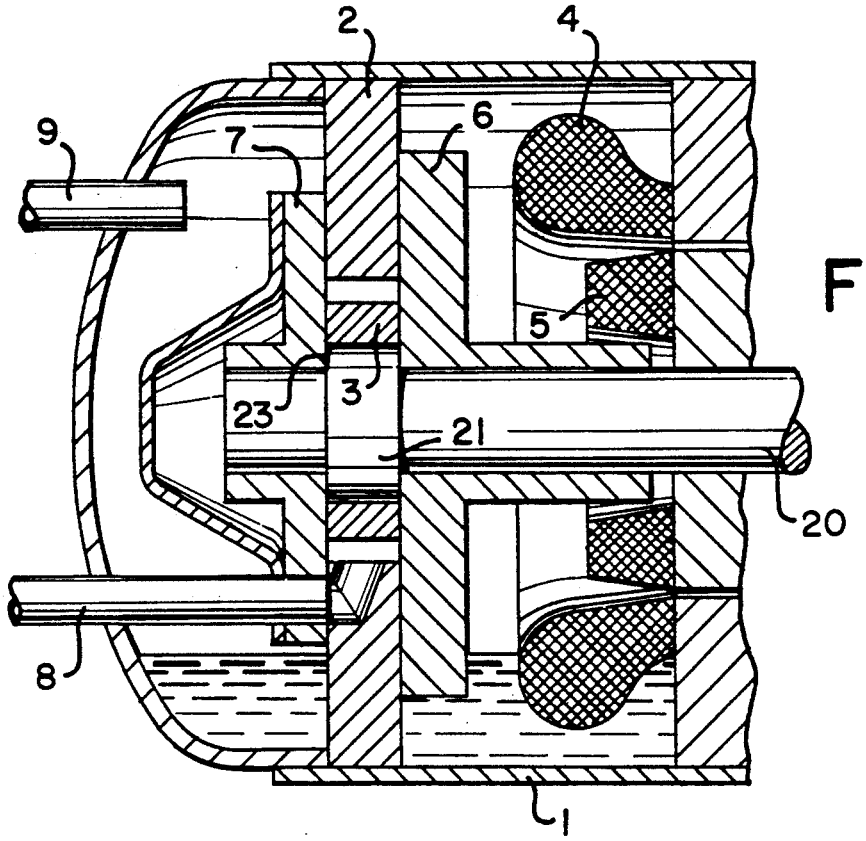
FIG. 1 is a partial longitudinal sectional view of a rotary hermetic compressor showing the crankshaft of the present invention.

As illustrated in FIG. 1, the crankshaft 20 in discussion is used, for example, in a rotary hermetic compressor and includes a hermetic shell 1 housing a cylinder 2 and rolling piston 3 set with an eccentric portion 21 mounted on a crankshaft 20. The crankshaft 20 is driven by an electric motor having a stator 4 and a rotor 5. The crankshaft 20 rotates within a main bearing 6 and sub bearing 7. The end portion of the shell 1 has a suction tube 8 which extends into the chamber defined between the eccentric 21 and the cylinder 2 and a discharge tube 9.

Figure 3:
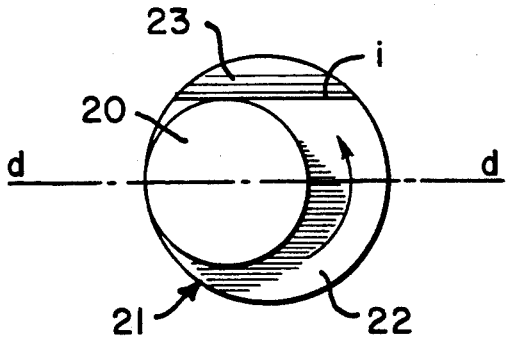
FIG. 3 is an end view of the eccentric portion of the crankshaft of FIG. 2.
Figure 2:
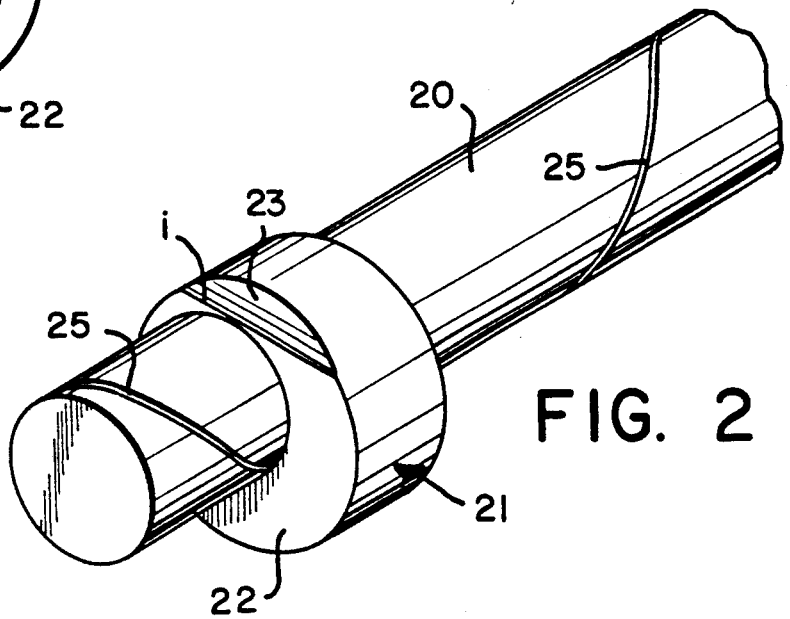
FIG. 2 is, in an amplified scale, a perspective view of the crankshaft of the invention, according to a first embodiment.

FIGS. 2, 3 and 4 illustrate the crankshaft 20 built according to a preferred embodiment of the present invention. The outer face, or bearing face, 22 of the eccentric portion 21 can be considered in sections. There is an intersection line i (FIG. 3) tangent to the crankshaft 20 and, parallel to the diameter d—d of the said outer bearing face 22. The diameter line d—d extends across the crankshaft and the eccentric portion 22 through the points of minimum and maximum eccentricity. The section line is parallel to the diameter line d—d. As illustrated, intersection line i defines a section with an inclined surface 23 in one of the sections of the bearing face 22.

The inclined surface section 23 is inclined relative to the remainder of the bearing face 22 of the eccentric portion 21 by an angle $\alpha$ which is in the range between slightly greater than 0° and about 5° (See FIG. 4), i.e. $0° < \alpha < 5°$.

The most suitable values for the angle $\alpha$ are determined in terms of the geometry of the crankshaft, eccentric portion and axial bearing set and also, the compressor operational characteristics, in a way to allow that the inclined surface 23 functions effectively as a hydrodynamic wedge, assuring a suitable lubrication of the axial bearing support face which, in the embodiment illustrated, is defined by the sub bearing plate 7.

As illustrated in FIGS. 2 and 4, the crankshaft 20 is provided with a helicoidal groove 25 along a part of its length for the conduction of lubrication to the compressor bearings.

In the embodiment of FIGS. 5, 6 and 7, the outer face 22 of the eccentric portion 21 is sectioned with a surface portion 23*a* which can be inclined, according to a helical surface that defines, together with the end face 22, a radial intersection line ia which creates with the diameter line d—d a section of the eccentric of an angle $\beta$ varying from 0° to about 45°. The portion of the outer face clockwise of the line 10 is planar with the other planar section of the outer surface. That is, the helical inclined section 23*a* can be from about 180° ($\beta$ is 0°) to about 135° (180°—a $\beta$ of 45°).

The surface section 23*a* can be inclined at an angle of from up to about 5° with the end face 22 plane. Surface 23*a* need not be inclined, i.e. it can be coplanar with end face 22, since the helical shape forms the hydrodynamic wedge. As seen in FIGS. 5 and 7 it takes the form of a helical surface portion arranged around part of the crankshaft periphery.

In the embodiment of FIGS. 5, 6 and 7, the inclined end face portion helical surface portion 23*a* crosses the diametrical plane which has the mentioned diameter d—d, at the minimum eccentricity, or null, region of the eccentric portion 21, at a point axially displaced along the crankshaft regarding the end face 22 plane (see FIG. 7).

In this second embodiment, the helical surface 23*a* which defines the hydrodynamic wedge is initiated at the outer face 22 minimum eccentricity point of the eccentric portion 21, with a certain axial setback regarding the plane of the end face 22 and, is extended in helicoidal development, occupying the whole surface of one of the halves of the said end face 22, until crossing the plane of this last one according to a radial intersection line ia also laid out at the same half of the end face 22 and creating an angle $\beta$ with the said diameter d—d.

Despite being described and illustrated here only two embodiments of the present invention, it should be understood that it will be possible to make changes without digressing from the inventive concept defined in the claims.

What is claimed is:

1. A hermetic compressor comprising:

a cylinder, a rolling piston, a crankshaft having an eccentric portion extending therefrom with a bearing surface, said eccentric portion bearing surface having a first section, means for rotating said crankshaft to rotate the eccentric portion and the rolling piston within the cylinder, an axial thrust bearing adjacent said cylinder having a surface which said eccentric portion bearing surface faces during its rotation, said eccentric portion first section including a part shaped to provide a hydrodynamic wedge with the axial thrust bearing surface.

2. A hermetic compressor as in claim 1 wherein the major part of the eccentric portion bearing surface is generally planar, said part of the eccentric portion bearing surface first section for providing the hydrodynamic wedge being an inclined surface relative to the remainder of the planar surface of the eccentric portion bearing surface.

3. A hermetic compressor as in claim 2 wherein said first section of the eccentric portion bearing surface is within an area defined by an extension of a diametrical line transverse to the center of the crankshaft at the point of maximum eccentricity of the eccentric portion bearing surface.

4. A hermetic compressor as in claim 2 wherein the base line of the area of said inclined surface portion of said eccentric portion first section is parallel to a diametrical line transverse to the center of the crankshaft and is tangent to the crankshaft.

5. A hermetic compressor as in claim 2 wherein the angle of the inclined portion of said first section which forms the hydrodynamic wedge is in the range of somewhat greater than 0° to about 5°.

6. A hermetic compressor as in claim 3 wherein the angle of the inclined portion of said first section which forms the hydrodynamic wedge is in the range of somewhat greater than 0° to about 5°.

7. A hermetic compressor as in claim 4 wherein the angle of the inclined portion of said first portion which forms the hydrodynamic wedge is in the range of somewhat greater than 0° to about 5°.

8. A hermetic compressor as in claim 2 wherein said portion of the eccentric portion first section for providing the hydrodynamic wedge is helicoidal in shape relative to the axial length of the crankshaft.

9. A hermetic compressor as in claim 8 wherein said helicoidal surface portion commences at the minimum area point of eccentric portion bearing surface eccentricity.

10. A hermetic compressor as in claim 8 wherein the helicoidal surface portion commences at a point along the length of the crankshaft which is set back relative to the remainder of the planar face of the eccentric portion bearing surface.

11. A hermetic compressor as in claim 8 wherein said helicoidal surface portion extends for all of the surface of said first section except for a section of angle in the range of from 0° to about 45°.

12. A hermetic compressor as in claim 9 wherein said helicoidal surface portion extends for all of the surface of said first section except for a section of angle in the range of from 0° to about 45°.

13. A hermetic compressor as in claim 10 wherein said helicoidal inclined surface portion extends for all of the surface of said first section except for a section of angle in the range of from 0° to about 45°.

14. A hermetic compressor as in claim 11 wherein the helicoidal inclined surface portion of said first section which forms the hydrodynamic wedge is inclined from the remaining planar face of the eccentric portion bearing surface at an angle in the range of somewhat greater than 0° to about 5°.

15. A hermetic compressor as in claim 12 wherein the helicoidal inclined surface portion of said first section which forms the hydrodynamic wedge is inclined from the remaining planar face of the eccentric portion bearing surface at an angle in the range of somewhat greater than 0° to about 5°.

16. A hermetic compressor as in claim 13 wherein the helicoidal inclined surface portion of said first section which forms the hydrodynamic wedge is inclined from the remaining planar face of the eccentric portion bearing surface at an angle is in the range of somewhat greater than 0° to about 5°.

* * * * *